US012005495B2

(12) United States Patent
Cao et al.

(10) Patent No.: US 12,005,495 B2
(45) Date of Patent: Jun. 11, 2024

(54) STEEL LADLE DRAINAGE METHOD

(71) Applicant: HEBEI VOCATIONAL UNIVERSITY OF INDUSTRY AND TECHNOLOGY, Hebei (CN)

(72) Inventors: Lei Cao, Hebei (CN); Yanjun Meng, Hebei (CN); Zhen Cao, Hebei (CN); Weiqing Huang, Hebei (CN); Yongliang Shi, Hebei (CN); Bin Yang, Hebei (CN); Zhongqi Dong, Hebei (CN); Yanxia Liu, Hebei (CN); Min Chen, Hebei (CN); Shanshan Zhang, Hebei (CN)

(73) Assignee: HEBEI VOCATIONAL UNIVERSITY OF INDUSTRY AND TECHNOLOGY, Hebei (CN)

( * ) Notice: Subject to any disclaimer, the term of this patent is extended or adjusted under 35 U.S.C. 154(b) by 7 days.

(21) Appl. No.: 18/010,450

(22) PCT Filed: Oct. 29, 2021

(86) PCT No.: PCT/CN2021/127208

§ 371 (c)(1),
(2) Date: Dec. 14, 2022

(87) PCT Pub. No.: WO2022/142667

PCT Pub. Date: Jul. 7, 2022

(65) Prior Publication Data

US 2023/0256505 A1 Aug. 17, 2023

(30) Foreign Application Priority Data

Dec. 28, 2020 (CN) ..... 202011582969.6

(51) Int. Cl.
*B22D 41/14* (2006.01)
*B22D 41/24* (2006.01)
(Continued)

(52) U.S. Cl.
CPC ..... *B22D 41/56* (2013.01); *B22D 41/14* (2013.01); *B22D 41/24* (2013.01); *B22D 41/26* (2013.01); *B22D 41/44* (2013.01); *B22D 41/48* (2013.01)

(58) Field of Classification Search
CPC ..... B22D 41/00; B22D 41/14; B22D 41/22; B22D 41/24; B22D 41/26; B22D 41/38; B22D 41/44; B22D 41/48
See application file for complete search history.

(56) References Cited

FOREIGN PATENT DOCUMENTS

| | | | | |
|---|---|---|---|---|
| CN | 201008971 | Y | * | 1/2008 |
| KR | 2020090000384 | U | * | 1/2009 |
| KR | 1020130120872 | A | * | 11/2013 |

* cited by examiner

*Primary Examiner* — Kevin E Yoon

(57) ABSTRACT

A steel ladle drainage method is achieved by using a steel ladle structure. Vacuum interlayers are provided within an upper nozzle, an upper fixed plate, a lower fixed plate and a sliding plate of the steel ladle structure respectively. In the steel ladle drainage method provided by the present invention, a metal drainage agent is used to replace the drainage sand in the prior art, the metal drainage agent is melted by the liquid steel and deposited in the upper nozzle, the sliding plate with the vacuum interlayer and the upper nozzle with the vacuum interlayer have the insulation effect on the melted metal drainage agent. Moreover, through moving the sliding plate, the two pouring holes of the upper and lower fixed plates are connected with each other, the metal drainage agent enters the tundish through the pouring holes and the lower nozzle under the action of gravity.

5 Claims, 1 Drawing Sheet

(51) Int. Cl.

| | |
|---|---|
| ***B22D 41/26*** | (2006.01) |
| ***B22D 41/44*** | (2006.01) |
| ***B22D 41/48*** | (2006.01) |
| ***B22D 41/56*** | (2006.01) |

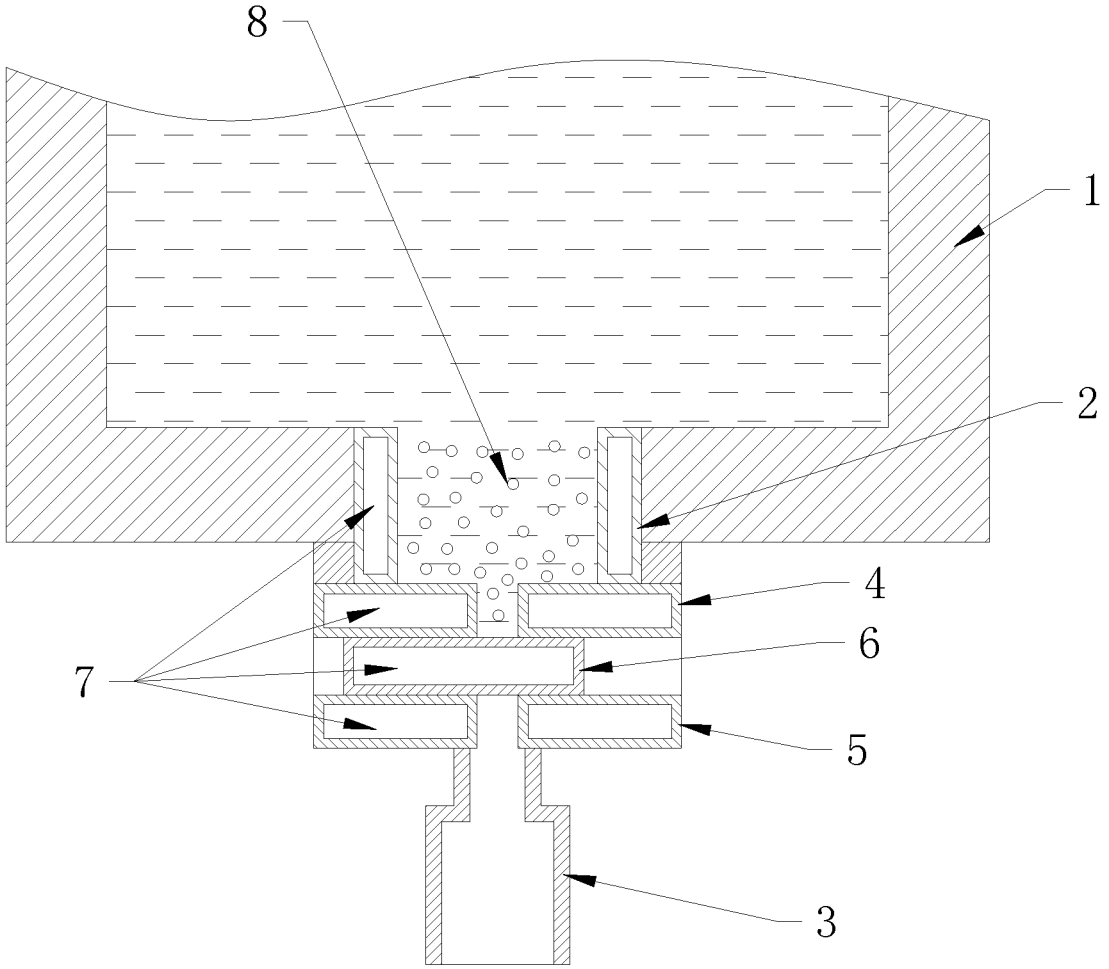
8
1
2
4
6
7
5
3

STEEL LADLE DRAINAGE METHOD

CROSS REFERENCE OF RELATED APPLICATION

The present invention claims priority under 35 U.S.C. 119(a-d) to CN 202011582969.6, filed Dec. 28, 2020. The entire contents of the Chinese patent application are incorporated by reference in the present invention.

BACKGROUND OF THE PRESENT INVENTION

Field of Invention

The present invention relates to the field of casting steel technology, and more particularly to a steel ladle drainage method.

Description of Related Arts

Before the steel ladle is loaded with the liquid steel, it is generally necessary to load the solid granular drainage sand with high melting point into the ladle nozzle. In the continuous casting process, the sliding plate of the steel ladle moves, so as to allow the drainage sand to automatically enter the tundish through the lower nozzle and the long nozzle of the steel ladle under the action of gravity and the static pressure of liquid steel. If the drainage sand is not available, the liquid steel will enter the cylindrical ladle nozzle. The temperature of the liquid steel in the cylindrical ladle nozzle will decrease with time, resulting in solidification to form solid cast steel, which will block the ladle nozzle, and the liquid steel in the ladle nozzle is unable to automatically enter the tundish through the ladle nozzle. Therefore, the drainage sand is introduced into the ladle nozzle before steel tapping is able to realize the smooth drainage of the liquid steel. However, as a foreign impurity, the drainage sand is inevitably flushed into the liquid steel in the tundish, causing pollution to the liquid steel and seriously affecting the cleanliness of the liquid steel.

Considering the pollution of solid oxide drainage sand to liquid steel, many researchers have studied how to separate the drainage sand from the liquid steel during the drainage process. However, no convenient, fast and efficient separation method has been developed. In most cases, the solid oxide drainage sand is forced to enter the liquid steel in the tundish, which seriously affects the cleanliness of the liquid steel, especially in the production of steel with high cleanliness requirements, the use of solid oxide drainage sand has a greater impact.

SUMMARY OF THE PRESENT INVENTION

An object of the present invention is to provide a steel ladle drainage method which is able to solve problems that solid oxide drainage sand affects the cleanliness of liquid steel and is difficult to be separated from the liquid steel.

In order to achieve the object, the present invention adopts technical solutions as follows. The present invention provides a steel ladle drainage method using a steel ladle structure, wherein:

the steel ladle structure comprises:

a ladle body, wherein a ladle nozzle is provided at a bottom of the ladle body; and an opening and closing device installed on the ladle nozzle for separating the ladle nozzle into an upper nozzle and a lower nozzle, wherein:

the opening and closing device comprises an upper fixed plate connected with a bottom portion of the upper nozzle and a lower fixed plate connected with a top portion of the lower nozzle;

the upper and lower fixed plates have two pouring holes respectively, a sliding plate is movably arranged between the upper and lower fixed plates for plugging or connecting the two pouring holes, vacuum interlayers are provided within the upper nozzle, the upper and lower fixed plates and the sliding plate respectively;

the steel ladle drainage method comprises steps of:

(S1) plugging the two pouring holes of the upper and lower fixed plates by moving the sliding plate, and baking the ladle body;

(S2) introducing a metal drainage agent into the ladle body, and then adding liquid steel into the ladle body, melting the metal drainage agent by the added liquid steel, and depositing the melted metal drainage agent in the upper nozzle;

(S3) refining the ladle body in an LF (ladle furnace) and a RH furnace; and (S4) connecting the two pouring holes of the upper and lower fixed plates by moving the sliding plate, and the metal drainage agent entering a tundish through the two pouring holes and the lower nozzle under an action of gravity for draining the liquid steel.

Preferably, the sliding plate is rotatably or slidably arranged between the upper and lower fixed plates through a driving device.

Preferably, in the step of (S1), a temperature of the ladle body is higher than 900° C. after being baked.

Preferably, in the step of (S2), the metal drainage agent is lead, lead-bismuth alloy or lead-antimony alloy.

Preferably, in the step of (S3), refining the ladle body for 1 h-1.5 h.

Preferably, after the step of (S4), the steel ladle drainage method further comprises a step of analyzing the liquid steel in the tundish by interval sampling to detect a residual amount of the metal drainage agent in the liquid steel.

Beneficial effects of the steel ladle drainage method provided by the present invention are as follows. According to the present invention, the metal drainage agent is used to replace the drainage sand in the prior art, the metal drainage agent is melted by the liquid steel and deposited in the upper nozzle, the sliding plate with the vacuum interlayer and the upper nozzle with the vacuum interlayer have the insulation effect on the melted metal drainage agent, so as to avoid the temperature of the melted metal drainage agent falling below the melting point and resulting in solidification. Moreover, through moving the sliding plate, the two pouring holes of the upper and lower fixed plates are connected with each other, the metal drainage agent enters the tundish through the pouring holes and the lower nozzle under the action of gravity, so as to drain the liquid steel. The metal drainage agent has no pollution to the liquid steel, which ensures the cleanliness of the liquid steel.

BRIEF DESCRIPTION OF THE DRAWINGS

In order to more clearly explain technical solutions of embodiments provided by the present invention, drawings that need to be used in the embodiments or prior arts are briefly described as follows. Obviously, the drawings described below are only some embodiments of the present invention. For those skilled in the art, other drawings are able to be obtained based on these drawings without creative effort.

The drawing is a structural schematic diagram of a steel ladle structure according to a preferred embodiment of the present invention.

In the drawing, 1: ladle body; 2: upper nozzle; 3: lower nozzle; 4: upper fixed plate; 5: lower fixed plate; 6: sliding plate; 7: vacuum interlayer; 8: metal drainage agent.

DETAILED DESCRIPTION OF THE PREFERRED EMBODIMENT

In order to make technical problems to be solved, technical solutions and beneficial effects of the present invention clearer, the present invention will be further described in detail with reference to accompanying drawings and embodiments as below. It should be understood that the specific embodiments described herein are intended only to interpret the present invention and are not intended to limit the present invention.

Referring to the drawing, a steel ladle drainage method provided by the present invention is illustrated. The steel ladle drainage method is achieved by using a steel ladle structure. The steel ladle structure comprises a ladle body 1 and an opening and closing device.

A ladle nozzle is provided at a bottom of the ladle body 1; the opening and closing device is installed on the ladle nozzle for separating the ladle nozzle into an upper nozzle 2 and a lower nozzle 3, wherein the opening and closing device comprises an upper fixed plate 4 connected with a bottom portion of the upper nozzle 2 and a lower fixed plate 5 connected with a top portion of the lower nozzle 3, the upper and lower fixed plates 4, 5 have two pouring holes respectively, a sliding plate 6 is movably arranged between the upper and lower fixed plates 4, 5 for plugging or connecting the two pouring holes, vacuum interlayers 7 are provided within the upper nozzle 2, the upper and lower fixed plates 4, 5 and the sliding plate 6 respectively.

The steel ladle drainage method comprises steps of:

(51) plugging the two pouring holes of the upper and lower fixed plates 4, 5 by moving the sliding plate 6, and baking the ladle body 1;

(S2) introducing a metal drainage agent 8 into the ladle body 1, and then adding liquid steel into the ladle body 1, melting the metal drainage agent 8 by the added liquid steel, and depositing the melted metal drainage agent 8 in the upper nozzle 2;

(S3) refining the ladle body 1 in an LF (ladle furnace) and a RH furnace; and (S4) connecting the two pouring holes of the upper and lower fixed plates 4, 5 by moving the sliding plate 6, and the metal drainage agent 8 entering a tundish through the two pouring holes and the lower nozzle 3 under an action of gravity for draining the liquid steel.

According to the present invention, the metal drainage agent 8 is used to replace the drainage sand in the prior art, the metal drainage agent 8 is melted by the liquid steel and deposited in the upper nozzle 2, the sliding plate 6 with the vacuum interlayer and the upper nozzle with the vacuum interlayer have the insulation effect on the melted metal drainage agent 8, so as to avoid the temperature of the melted metal drainage agent falling below the melting point and resulting in solidification. Moreover, through moving the sliding plate 6, the two pouring holes of the upper and lower fixed plates 4, 5 are connected with each other, the metal drainage agent 8 enters the tundish through the pouring holes and the lower nozzle 3 under the action of gravity, so as to drain the liquid steel. The metal drainage agent 8 has no pollution to the liquid steel, which ensures the cleanliness of the liquid steel.

Moreover, the lower nozzle 3 is long, which is able to increase a transmission distance of the liquid steel in the lower nozzle, and reduce an amount of heat conducted to an outside by the liquid steel.

As the preferred embodiment of the steel ladle drainage method provided by the present invention, referring to the drawing, the sliding plate 6 is rotatably or slidably arranged between the upper and lower fixed plates 4, 5 through a driving device.

According to the preferred embodiment, the sliding plate 6 is able to move in a reciprocating straight line or rotatably by a hydraulic device or an electrical device. According to the relative position of the two pouring holes of the upper fixed plate 4 and the lower fixed plate 5, namely, a contact ratio of the two pouring holes, a flow rate of the molten steel pouring is able to be controlled to achieve plugging and full opening.

Preferably, the metal drainage agent 8 is a metal or alloy with low melting point and high density, such as lead, lead-bismuth alloy and lead-antimony alloy.

At present, although the melting point of many metals, such as mercury and gallium, is lower than the ambient temperature of 900° C. in the ladle nozzle, the melting point of mercury and gallium is lower than 30° C., that is, mercury and gallium exist in liquid form at room temperature, which is not convenient to transport, store and add to the ladle nozzle. Therefore, mercury and gallium are not suitable for use as the drainage agent. There are also many metals with melting points higher than 30° C. and lower than 900° C., such as aluminum has the melting point of 660° C., magnesium has the melting point of 651° C., stannum has the melting point of 232° C., antimony has the melting point of 630° C., and zinc has the melting point of 419° C. However, the density of these metals with low melting point is less than that of the liquid steel, so these metals are also not suitable as the drainage agent. Therefore, at present, the most suitable metal is lead with the melting point of 327° C. and the density of 11.4 g/cm$^3$, or bismuth with the melting point of 271° C. and the density of 9.8 g/cm$^3$. Further, through the multicomponent mixture, more alloys with low melting point and high density, such as lead-bismuth alloy, are obtained.

Due to the high temperature of the liquid steel, above 1550° C., the metal drainage agent 8 with low melting point and high density in the ladle nozzle is heated and melted. Since the density of lead and lead-bismuth alloy is 11.4 kg/cm$^3$, which is higher than that of the liquid steel (7.8 kg/cm$^3$), the metal drainage agent will not float up due to the injection of the liquid steel, and will be deposited in the upper nozzle 2.

At 1550-1600° C., the solubility of Pb in Fe is only about 0.3%, and the solubility of Bi in Fe is only about 0.2%. Therefore, after being added to the ladle body 1, the metal with high density and low melting point, such as lead and lead-bismuth alloy, is dissolved into a liquid; the metal will not be infinitely soluble with the liquid steel due to the limited solubility in the liquid steel, and will remain in the lower nozzle 3 which is provided below the liquid steel due to the density of the metal is greater than that of the liquid steel.

The vacuum interlayers 7 are provided within the upper nozzle 2, the sliding plate 6, the upper and lower fixed plates 4, 5 respectively, which greatly reduces the amount of heat conducted to an outside and reduces the decrease in temperature of the liquid metal drainage agent 8 in the ladle nozzle, ensures that the temperature of the metal drainage agent 8 is higher than the melting point, so as to prevent the liquid metal drainage agent 8 in the pouring holes from solidifying and blocking the pouring holes due to the temperature decrease caused by the long stationary time.

As for whether lead-bismuth alloy entering the liquid steel in the tundish will affect the composition and performance of the liquid steel, it is able to be found by querying the national standard of different steel types that Pb and Bi content is not strictly limited in the national standard. For example, in the low alloy high strength structural steel GB-T/1591-2008, there is a clear limit value of Cr\Cu, Ni and other residual elements that affect the performance of steel, which is less than 0.3%; while the residual elements of steel, such as Pb and Bi, are not strictly stipulated. In addition, Pb and Bi alloys are not included in the calculation formulas of carbon equivalent CEV and crack resistance sensitivity index PCM which affect the properties of steel, indicating that Pb and Bi alloys do not have a serious impact on the performances of steel.

The liquid steel in the tundish is analyzed by interval sampling to detect a residual amount of the metal drainage agent 8 in the liquid steel. According to the preferred embodiment, for 100 t of the steel ladle, only 20-30 kg of lead or lead-bismuth alloy is required, which is very small in amount. Take 25 kg as an example.

After the steel ladle is poured, the metal drainage agent 8 in the liquid steel in the tundish is sampled and analyzed every 2 min, and the specific results, namely, the contents of the metal drainage agent 8 in the liquid steel by weight are as follows respectively.

at the beginning of pouring: 0.06%
2 min: 0.069%
4 min: 0.065%
6 min: 0.030%
8 min: 0.005%
10 min: 0.001%.

It is able to seen that the highest content of the metal drainage agent 8 in the liquid steel is at 2 min after the metal drainage agent 8 enters the liquid steel, but the highest content is only 0.069%. At the same time, the internal quality and the external quality of the continuous casting billet produced by this method are checked, and no internal and external quality defects are found. Through production tracking, the performances of the rolled steel plate is good, and not affected by this method.

The foregoing are only preferred embodiments of the present invention and are not intended to limit the present invention. Any modification, equivalent substitution and improvement made within the principles of the present invention shall be included within the protection scope of the present invention.

What is claimed is:

1. A steel ladle drainage method using a steel ladle structure, wherein:

the steel ladle structure comprises:

a ladle body, wherein a ladle nozzle is provided at a bottom of the ladle body; and an opening and closing device installed on the ladle nozzle for separating the ladle nozzle into an upper nozzle and a lower nozzle, wherein:

the opening and closing device comprises an upper fixed plate connected with a bottom portion of the upper nozzle and a lower fixed plate connected with a top portion of the lower nozzle;

the upper and lower fixed plates have two pouring holes respectively, a sliding plate is movably arranged between the upper and lower fixed plates for plugging or connecting the two pouring holes, vacuum interlayers are provided within the upper nozzle, the upper and lower fixed plates and the sliding plate respectively;

the steel ladle drainage method comprises steps of:

(S1) plugging the two pouring holes of the upper and lower fixed plates by moving the sliding plate, and baking the ladle body;

(S2) introducing a metal drainage agent into the ladle body, and then adding liquid steel into the ladle body, melting the metal drainage agent by the added liquid steel, and depositing the melted metal drainage agent in the upper nozzle;

(S3) refining the ladle body in an LF (ladle furnace) and a RH furnace; and (S4) connecting the two pouring holes of the upper and lower fixed plates by moving the sliding plate, and the metal drainage agent entering a tundish through the two pouring holes and the lower nozzle under an action of gravity for draining the liquid steel, wherein the step of (S2), the metal drainage agent is lead, lead-bismuth alloy or lead-antimony alloy.

2. The steel ladle drainage method according to claim 1, wherein the sliding plate is rotatably or slidably arranged between the upper and lower fixed plates through a driving device.

3. The steel ladle drainage method according to claim 1, wherein in the step of (S1), a temperature of the ladle body is higher than 900° C. after being baked.

4. The steel ladle drainage method according to claim 1, wherein in the step of (S3), refining the ladle body for 1-1.5 h.

5. The steel ladle drainage method according to claim 1, wherein after the step of (S4), the steel ladle drainage method further comprises a step of analyzing the liquid steel in the tundish by interval sampling to detect a residual amount of the metal drainage agent in the liquid steel.

* * * * *